US008841529B2

(12) United States Patent
Rovner

(10) Patent No.: US 8,841,529 B2
(45) Date of Patent: Sep. 23, 2014

(54) CLARINET MOUTHPIECE AND BARREL SYSTEM

(71) Applicant: Philip Lee Rovner, Timonium, MD (US)

(72) Inventor: Philip Lee Rovner, Timonium, MD (US)

( * ) Notice: Subject to any disclaimer, the term of this patent is extended or adjusted under 35 U.S.C. 154(b) by 10 days.

(21) Appl. No.: 13/682,783

(22) Filed: Nov. 21, 2012

(65) Prior Publication Data

US 2014/0137718 A1 May 22, 2014

(51) Int. Cl.
*G10D 7/00* (2006.01)
*G10D 9/02* (2006.01)

(52) U.S. Cl.
CPC ..... *G10D 9/02* (2013.01)
USPC ..... 84/383 R; 84/382

(58) Field of Classification Search
USPC ..... 84/383 R
See application file for complete search history.

(56) References Cited

U.S. PATENT DOCUMENTS 1,667,836 A 5/1928 Brockman, Jr.
1,771,157 A 7/1930 Paul
1,809,380 A * 6/1931 Gulick ..... 84/382
2,095,605 A 10/1937 Georges
2,287,529 A 6/1942 Mario
2,296,737 A 9/1942 Peterson
2,368,556 A 1/1945 Mario
2,411,692 A 11/1946 Murano
2,499,855 A 3/1950 Gamble
2,517,077 A 8/1950 Berry
2,525,523 A 10/1950 Harry
3,150,554 A 9/1964 Marcel
3,433,113 A 3/1969 Portnoy
3,521,517 A 7/1970 Sato
3,759,132 A 9/1973 Backus
3,905,268 A 9/1975 Gamble
4,056,997 A 11/1977 Rovner
4,210,055 A 7/1980 Platamone
4,308,781 A 1/1982 Mcguerty
4,337,683 A 7/1982 Backus
4,428,271 A 1/1984 Winslow et al.
4,449,439 A 5/1984 Wells
4,517,875 A 5/1985 Dossekker
4,669,352 A 6/1987 Bichon
4,708,182 A 11/1987 Laker (Continued)

OTHER PUBLICATIONS

Article excerpts from "Downbeat" and "Clarinet Magazine" discussing the Rovner Barrel, 1979.

(Continued)

*Primary Examiner* — Christopher Uhlir
(74) *Attorney, Agent, or Firm* — August Law, LLC; George Willinghan

(57) ABSTRACT

A clarinet mouthpiece and tuning barrel system includes a mouthpiece with a central mouthpiece bore passing through the mouthpiece from a tone chamber to a rear portion of the mouthpiece opposite the tone chamber. The mouthpiece bore has a rectangular cross-sectional geometry extending along an entire length of the mouthpiece bore. This rectangular geometry includes two pairs of opposing parallel sides. Each pair of opposing sides is separated by a unique distance such that a ratio of unique distances for the two pairs of opposing parallel sides is ⅝. Also included is a tuning barrel attached to the rear portion of the mouthpiece. This barrel has a central barrel bore in communication with the mouthpiece bore that passes completely through the barrel. The barrel bore has an identical rectangular cross-sectional geometry to the mouthpiece bore cross-sectional geometry along an entire length of the barrel bore.

20 Claims, 1 Drawing Sheet

(56) References Cited

U.S. PATENT DOCUMENTS

| | | | | |
|---|---|---|---|---|
| 4,745,838 | A | 5/1988 | Johnson | |
| 4,941,385 | A | 7/1990 | Johnson | |
| 5,018,425 | A * | 5/1991 | Rovner | 84/383 R |
| 5,105,701 | A | 4/1992 | Hall et al. | |
| 5,192,821 | A | 3/1993 | Goldstein et al. | |
| 5,289,752 | A | 3/1994 | Barbaglia | |
| 5,293,805 | A | 3/1994 | Guardala et al. | |
| 5,303,628 | A | 4/1994 | Salazar | |
| 5,357,837 | A | 10/1994 | Disera | |
| 5,398,582 | A | 3/1995 | Smith | |
| 5,419,229 | A | 5/1995 | Van Doren | |
| 5,456,152 | A | 10/1995 | Cusack et al. | |
| 5,623,111 | A | 4/1997 | van Doren et al. | |
| 5,728,957 | A | 3/1998 | Valtchev | |
| D404,755 | S | 1/1999 | Garbuzov | |
| 5,973,245 | A | 10/1999 | Van Doren | |
| 5,998,715 | A | 12/1999 | Rovner | |
| 6,020,545 | A | 2/2000 | Consoli | |
| 6,118,060 | A | 9/2000 | Van Doren | |
| 6,130,376 | A | 10/2000 | Chang | |
| 6,150,593 | A | 11/2000 | Holden | |
| 6,259,010 | B1 * | 7/2001 | Nagahara | 84/380 R |
| 6,501,010 | B2 | 12/2002 | Sullivan | |
| 6,673,992 | B1 | 1/2004 | Runyon | |
| 7,169,993 | B2 | 1/2007 | Fliegel et al. | |
| 7,326,840 | B2 | 2/2008 | Wanne | |
| 7,465,864 | B2 | 12/2008 | Heintz | |
| 7,470,844 | B2 | 12/2008 | Espina | |
| 7,626,105 | B2 | 12/2009 | Rovner | |
| 7,635,287 | B2 | 12/2009 | May | |
| 7,667,118 | B1 | 2/2010 | Behn | |
| 7,825,317 | B1 * | 11/2010 | Lederman et al. | 84/330 |
| 7,863,509 | B2 | 1/2011 | Rovner | |
| 7,939,738 | B2 | 5/2011 | Rovner | |
| 7,982,112 | B2 | 7/2011 | Rovner | |
| 8,283,541 | B2 | 10/2012 | Rovner | |
| 2004/0011183 | A1 | 1/2004 | Fliegel et al. | |
| 2005/0061136 | A1 | 3/2005 | Rovner | |
| 2005/0061137 | A1 | 3/2005 | Rovner | |
| 2005/0072623 | A1 | 4/2005 | Rovner | |
| 2005/0087057 | A1 | 4/2005 | Taillard | |
| 2006/0272473 | A1 | 12/2006 | Kuo | |
| 2008/0022839 | A1 | 1/2008 | Sullivan | |
| 2009/0217798 | A1 | 9/2009 | Rovner | |
| 2009/0217800 | A1 | 9/2009 | Rovner | |
| 2010/0043621 | A1 | 2/2010 | Rovner | |
| 2011/0162508 | A1 | 7/2011 | Rovner | |
| 2011/0239843 | A1 * | 10/2011 | Brockman | 84/382 |

OTHER PUBLICATIONS

Passband, http://www.absoluteastronomy.com/topics/Passband viewed May 14, 2010.

Rovner ligatures, viewed May 14, 2010 at www.rovnerproducts.com/ligatures.com.

* cited by examiner

CLARINET MOUTHPIECE AND BARREL SYSTEM

FIELD OF THE INVENTION

The present invention relates to woodwind instruments and in particular to mouthpieces for woodwind instruments.

BACKGROUND OF THE INVENTION

Woodwind musical instruments, e.g., saxophones and clarinets, and other devices such as bird calls, utilize the vibration of a reed in response to a flow of air to generate a tone. These reeds include natural cane reeds and synthetic reeds. Tone generation in general depends on proper reed vibration. The reed is typically placed in contact with a mouthpiece to cover an opening or window. The reed is held in place by an adjustable clamp or ligature that surrounds the mouthpiece and the reed. Variations in the mouthpiece and ligature affect the vibration of the reed and, therefore, the performance or tone of the device or instrument.

The essential function of the mouthpiece of a woodwind instrument is to provide support for the reed over an aperture that allows the reed to vibrate and to direct the energy from the reed vibration through the aperture and into the bore of the instrument. The function and performance of a mouthpiece is influenced by the arrangement and geometry of the facing around the aperture as well as tone chamber below the reed which defines the route from the aperture to the bore. The facing is conventionally a flat surface on the mouthpiece surrounding the aperture, and the reed is placed in contact with this flat surface, covering the aperture. The facing includes the aperture, called a window, and the window is surrounded by a table on one end, two side rails extending from the table and a tip rail opposite the table. The reed functions as a reed valve during vibration, opening and closing the window.

A clarinet also includes a separate tuning barrel connected to the clarinet mouthpiece. The clarinet mouthpiece and the clarinet barrel are important components of the clarinet and contribute to the intonation, response, tone color and evenness of the clarinet. Typically, there is a distinct and very noticeable difference in tonality of the upper and lower registers of a clarinet. The very lowest register has a big-bodied tone; however, as the notes being played progress into the upper register, the tone loses its body and dimension, becoming relatively thin. As times, the tone can sound shrill. This effect is the result of the disparity in the cavity dimensions of the mouthpiece with respect to that of the relatively large bore of the instrument. When the lower notes are being played, the length of the oscillating air column is such that the generated tone is largely that which is developed in the bore of the instrument. When the higher notes are sounded, the tonality becomes more influenced by the cavity dimensions of the mouthpiece, which are relatively small in comparison to the cavity dimensions of the bore of the instrument. In regard to the lack of clarity of the throat tones, this is due to the fact that the transverse air column vibrations are not harmonically related to the longitudinal vibrations. Therefore, there is little harmonic cooperation. This condition exists in all wind instruments. Certain notes sound more clear than others in all instruments.

SUMMARY OF THE INVENTION

The present invention is directed to clarinet mouthpiece and barrel systems that mitigate the normal change in tonality between the upper and lower registers of a clarinet and improves the clarity of the throat tones of the instruments. By virtue of the principles involved in the construction of the system, a synergistic benefit in terms of a "bigger" tone and improved response is also realized.

Exemplary embodiments in accordance with the present invention improve instrument performance weaknesses by enlarging the cavity dimensions of the mouthpiece and altering the geometry of the mouthpiece and barrel bore to diversify the transverse dimensions. The mouthpiece chamber cavity is enlarged to an extent that a reed larger than a conventional clarinet reed, e.g., an alto saxophone reed, is needed to cover the mouthpiece chamber cavity. This modification results in upper notes sounding more full and substantive and having greater tonal dimension. In addition, by revising the bore geometry of both the mouthpiece and the barrel to be a shape other than circular, for example, rectangular, transverse oscillations are generated along a portion of the entire bore of the instrument that are more harmonically related to notes that are typically dull sounding notes, improving the tonal clarity of those notes.

Other playing characteristics have also benefited from the modified geometries of the clarinet mouthpiece and barrel system of the present invention. For example, the scale line is more even. In addition, the overall tone is bigger, and the response is significantly improved. These characteristics result from the increase in harmonic density that results from the diversity of bore dimensions that are created by the mouthpiece and barrel bore having a non-circular cross section, e.g., rectangular, cross section.

In accordance with one exemplary embodiment, the present invention is directed to a clarinet mouthpiece and barrel system containing a mouthpiece and a tuning barrel attached to the mouthpiece. The mouthpiece is constructed with a central mouthpiece bore passing through the mouthpiece from a tone chamber to a rear portion of the mouthpiece opposite the tone chamber. The mouthpiece bore has a cross-sectional geometry extending along an entire length of the mouthpiece bore with a plurality of pairs of opposing parallel sides. Each pair of opposing sides is separated by a unique distance. Preferably, the mouthpiece bore has a rectangular cross-sectional geometry with two pairs of opposing parallel sides. The unique distances separating the two pairs of opposing sides have a ratio that generates transverse harmonics through the mouthpiece bore related to wavelengths of notes in an upper register of a clarinet. This ratio is preferably ⅝. In one embodiment, the unique distances include a first distance of about 10 mm and a second distance of about 16 mm. In one embodiment, the unique distance associated with at least one of the pairs of opposing sides varies along the length of at least one of the mouthpiece bore and the tuning barrel bore.

The tuning barrel or barrel is attached to the rear portion of the mouthpiece. The barrel includes a central barrel bore in communication with the mouthpiece bore and passing completely through the barrel. The barrel bore has an identical cross-sectional geometry to the mouthpiece bore cross-sectional geometry along an entire length of the barrel bore. In one embodiment, the barrel bore has a rectangular cross-sectional geometry with two pairs of opposing parallel sides. The unique distances separating the two pairs of opposing sides have a ratio that generates transverse harmonics through the mouthpiece bore related to wavelengths of notes in an upper register of a clarinet. This ratio is preferably ⅝. In one embodiment, the unique distances include a first distance of about 10 mm and a second distance of about 16 mm. The barrel is arranged as a cylinder having an outer surface and a plurality of orientation marks spaced radially around the outer surface of the cylinder to indicate an orientation between the barrel bore cross-sectional geometry and at least one of the mouthpiece bore cross-sectional geometry and an instrument bore passing through the clarinet from the barrel to a bell end of the clarinet.

In one embodiment, the cross-sectional geometry of the mouthpiece bore and the barrel bore yields an associated acoustic impedance equivalent to a circular cross-section having an equivalent cross-sectional area. In one embodiment, the mouthpiece has a length of about 100 mm, and the mouthpiece bore has a length of about 35 mm. The barrel has a length of about 60 mm, and the barrel bore has a length of from about 25 mm to about 30 mm. The mouthpiece includes a tone chamber window in communication with the tone chamber. This tone chamber window has a length of from about 50 mm to about 55 mm. In one embodiment, the mouthpiece bore has a rectangular cross-sectional geometry with two pairs of opposing parallel sides, a longer pair and a shorter pair. The longer pair is oriented parallel to opposite sides of the tone chamber extending down from the tone chamber window.

DETAILED DESCRIPTION

Figure 1:
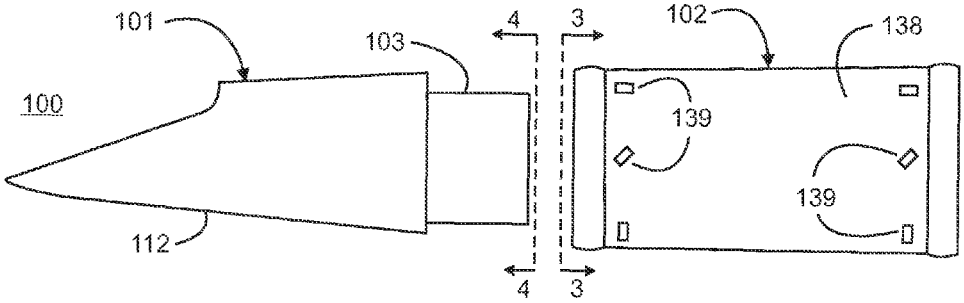
FIG. 1 is a view of an embodiment of the clarinet mouthpiece and barrel system in accordance with the present invention.
Figure 2:
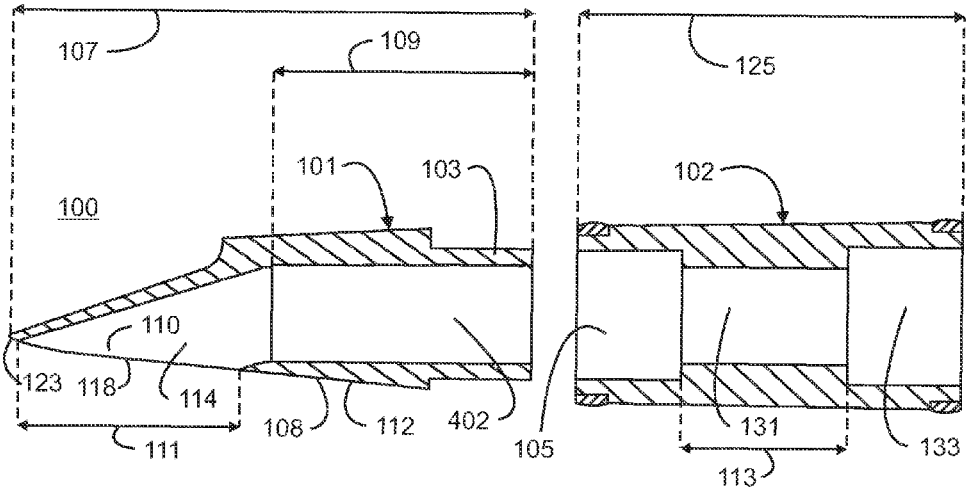
FIG. 2 is a cross-sectional view along the length of the clarinet and mouthpiece system of FIG. 1.

Referring to FIGS. 1 and 2, an exemplary embodiment of a clarinet mouthpiece and barrel system 100 in accordance with the present invention is illustrated. In general, the mouthpiece is arranged to support a reed that is secured to the mouthpiece with a ligature. Suitable arrangements of reeds and ligatures are known and available in the art. The clarinet mouthpiece and barrel system includes a mouthpiece 101 and a barrel 102. In one embodiment, the mouthpiece has a typically elongated or barrel shape that tapers to either end. On a bottom side 112 of the mouthpiece is an elongated window 110 having a generally rectangular shape. The window may be tapered or narrow at one end or the other. In addition, one end of the window can include a bow or arch to match or compliment the curvature of the end of the reed. The side of the mouthpiece containing the window is considered the bottom side, because that side typically faces down or is on the bottom of the mouthpiece when the mouthpiece is attached to a musical instrument, i.e., a clarinet.

The window 110 exposes a tone chamber 114 within the mouthpiece. In one embodiment, the tone chamber has a rectangular cross section when viewed across the side rails of the mouthpiece. The tone chamber is in communication with a central mouthpiece bore 402 passing through the mouthpiece from the tone chamber to a rear portion 103 of the mouthpiece opposite the tone chamber. The rear portion is arranged to engage in a complementary mouthpiece end cavity 105 extending into the barrel 102. This engagement attaches the mouthpiece to the barrel. In one embodiment, the rear portion 103 and complementary mouthpiece end cavity 105 are configured as complementary cylindrical shapes. In one embodiment, the mouthpiece bore meets the tone chamber at one end of the window, i.e., the mouthpiece bore does not extend into the portion of the mouthpiece exposed by the widow. Alternatively, the mouthpiece bore extends into the portion of the mouthpiece exposed by the window.

In general, the rear portion of the mouthpiece has a tapered or reduced diameter adapted to fit into the barrel in a conventional manner. In one embodiment, the mouthpiece has an overall length 107 from tip rail 123 to the end of the rear portion 103 of from about 80 mm to about 110 mm, preferably about 100 mm. The mouthpiece bore has a length 109 from the tone chamber 114 to the end of the rear portion 103 of from about 30 mm to about 40 mm, preferably about 35 mm. In one embodiment, the tone chamber window 111 has a length of from about 50 mm to about 55 mm. In general, this length is longer than a conventional clarinet mouthpiece; therefore, the mouthpiece is used in combination with a larger reed, e.g., an alto saxophone reed, in order to cover the larger tone chamber window.

In order to achieve the improved tonal performance with the mouthpiece and barrel system of the present invention, the mouthpiece bore is not circular in cross-section as in conventional clarinet mouthpieces. However, the non-circular cross section geometry is selected to have the same cross sectional area as a conventional circular bore in order to maintain the same acoustic impedance as that of a conventional circular bore. The mouthpiece bore has a cross-sectional geometry extending along the entire length of the mouthpiece bore that includes a plurality of pairs of opposing parallel sides. These parallel opposing sides establish standing waves that are transverse to the direction of propagation of the wavelengths traveling through the bore of the mouthpiece bore. This results in transverse harmonics in the mouthpiece bore. The number, size and arrangement of the parallel sides are selected based upon the wavelengths of the notes passing along the mouthpiece bore.

Figure 4:
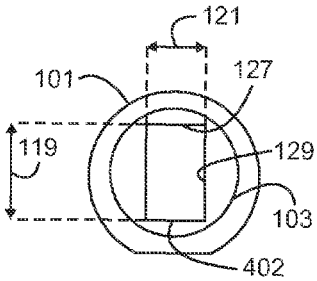
FIG. 4 is a view through line 4-4 of FIG. 1.

The number of pairs of opposing sides can be varied, for example, from two, three, four or more. This can result in a cross-sectional geometry that is a rectangle, square or hexagon, among other shapes. In addition, more complex shapes can be used, for example the intersection of two rectangles to yield a "+" or "x" cross-sectional shape. As illustrated in FIG. 4, the mouthpiece bore is preferably a rectangle. This embodiment includes two pairs of opposing sides. Each pair of opposing sides, regardless of the cross-sectional geometry selected, is separated by a unique distance. When the mouthpiece bore is rectangular, the two pairs of opposing parallel sides are separated by a first distance 121 and a second distance 119. The first distance 121 equals the length of the shorter set of opposing sides 127, and the second distance 119 equals the length of the longer set of opposing sides 129.

The unique distances separating the two pairs of opposing sides are selected based on a ratio that generates transverse harmonics through the mouthpiece bore related to wavelengths of notes in an upper register of a clarinet. Preferably, this ratio is ⅝. In one embodiment in accordance with this ratio, the first distance 121 is about 10 mm, and the second distance 119 is about 16 mm. These distances can be constant along the length of the mouthpiece bore or can be varied either continuously or in discrete "step down" or step up" configurations. The transverse waves generated by the two sets of opposing sides in the rectangle are orthogonal. In one embodiment, the longer pair of opposing sides 129 are oriented parallel to opposite sides of the tone chamber extending down from the tone chamber window.

The barrel 102 attached to the rear portion of the mouthpiece includes a central barrel bore in communication with the mouthpiece bore 402 and passing completely through the barrel. The barrel bore has a complementary and preferably an identical cross-sectional geometry to the mouthpiece bore cross-sectional geometry along an entire length of the barrel bore. Therefore, the barrel has an overall length 125 from about 50 mm to about 70 mm, preferably about 60 mm. The mouthpiece bore has a length 113 of from about 25 mm to about 30 mm. This is because of the mouthpiece end cavity 105 at one end of the barrel and the instrument end cavity 133 at the opposite end of the barrel that extend into the barrel, reducing the length of the barrel bore. The instrument end cavity is configured to attach the barrel to the musical instrument, i.e., the clarinet, such that the mouthpiece bore and barrel bore are in communication with the bore running through the clarinet.

In order to achieve the improved tonal performance with the mouthpiece and barrel system of the present invention, the barrel bore is not circular in cross-section as in conventional clarinet barrels. However, the non-circular cross section geometry is selected to have the same cross sectional area as a conventional circular bore. The barrel bore has a cross-sectional geometry extending along the entire length of the barrel bore that includes a plurality of pairs of opposing parallel sides. These parallel opposing sides establish waves that are transverse to the direction of propagation of the wavelengths traveling through the bore of the barrel bore. This results in transverse harmonics in the barrel bore. The number, size and arrangement of the parallel sides are selected based upon the wavelengths of the notes passing along the barrel bore.

Figure 3:
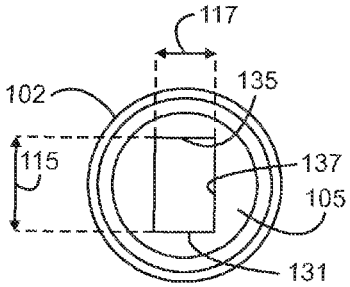
FIG. 3 is a view through line 3-3 of FIG. 1.

The number of pairs of opposing sides can be varied, for example, from two, three, four or more. This can result in a cross-sectional geometry that is a rectangle, square or hexagon, among other shapes. In addition, more complex shapes can be used, for example the intersection of two rectangles to yield a "+" or "x" cross-sectional shape. As illustrated in FIG. 3, the barrel bore is preferably a rectangle. This embodiment includes two pairs of opposing sides. Each pair of opposing sides, regardless of the cross-sectional geometry selected, is separated by a unique distance. When the barrel bore is rectangular, the two pairs of opposing parallel sides are separated by a first distance 117 and a second distance 115. The first distance 117 equals the length of the shorter set of opposing sides 135, and the second distance 115 equals the length of the longer set of opposing sides 137.

The unique distances separating the two pairs of opposing sides are selected based on a ratio that generates transverse harmonics through the barrel bore related to wavelengths of notes in an upper register of a clarinet. Preferably, this ratio is ⅝. In one embodiment in accordance with this ratio, the first distance 117 is about 10 mm, and the second distance 115 is about 16 mm. These distances can be constant along the length of the barrel bore or can be varied either continuously or in discrete "step down" or step up" configurations. The transverse waves generated by the two sets of opposing sides in the rectangle are orthogonal. In addition, the distances can be constant or varied along the length of both the mouthpiece bore and the barrel bore. In general, extending the non-circular cross-sectional shape through both the mouthpiece and the bore provides a longer distance in which to establish the desired transverse harmonics that yield the improved tonality in the clarinet. The cross-sectional geometry of the mouthpiece bore and the barrel bore yields an associated impedance equivalent to a circular cross-section bore having an equivalent cross-sectional area.

The barrel 102 is a cylinder having an outer surface 138 and a plurality of orientation marks 139 spaced radially around the outer surface of the cylinder to provide and to indicate an orientation between the barrel bore cross-sectional geometry and at least one of the mouthpiece bore cross-sectional geometry and an instrument bore passing through the clarinet from the barrel to a bell end of the clarinet. In other embodiments, these marks be configured as any suitable number and arrangement of icons that perform a similar function.

Other features of the mouthpiece and barrel system include a table 108 is disposed at one end of the window. The table is a flat surface on the bottom side of the mouthpiece and is situated to engage a portion of a reed adjacent the heel end of the reed. This flat surface is the top of the table, and the top engages the portion of the reed adjacent the heel end of the reed. The ligature securing the reed to the mouthpiece surrounds the mouthpiece around the table region of the mouthpiece. In one embodiment, the table has an overall length of from about 15 mm to about 20 mm, preferably about 17 mm.

The mouthpiece also includes a pair of side rails 118 running along opposite sides of the window 110. Each side rail 118 frames one side of the window 110. The side rails 118 extend from the table 108. In one embodiment, the side rails extend perpendicularly from the table. Alternatively, the side rails flare outwards as they extend from the table. The side rails are parallel in that the side rails do not cross or intersect in the region of the window. Each side rail includes a side rail top surface running along the length of the side rail. The top surface of each side rail contacts a portion of the reed. In one embodiment, each side rail has a length of about 50 mm. In one embodiment, the width of each side rail top surface varies from about 3 mm at the table to about 1 mm at the other end of the side rail. In one embodiment, each side rail top surface is coplanar with the table top. Alternatively, each side rail top surface is coplanar with the table top at the point of intersection of the side rail with the table top and subsequently curves away from the plane of the table top. This curvature provides for separation between the reed and the side rail top surfaces at an end of the reed opposite the heel end. This separation occurs, for example, when the reed is attached to the mouthpiece and is not vibrating. Vibration of the reed causes the reed to come into contact with the side rail top surfaces along the entire length of the top rails. The reed in combination with the window acts as a valve for the tone chamber.

The mouthpiece also includes a tip rail 123. The tip rail extends between the side rails at an end of the window opposite the table. In one embodiment, the tip rail extends along a generally straight line between the side rails. Preferably, the tip rail follows an outward arc between the side rails. The tip rail is in contact with the reed when the reed vibrates to close the window in the tone chamber. In one embodiment, the tip rail spans a distance between the side rails of about 15 mm. The shape of the tip rail can be the same as the shape of the tip of the reed or can be an arc having a different curvature than the tip of the reed. The tip rail top surface is the portion of the tip rail that comes onto contact with the reed. In one embodiment, the tip rail top surface has a width of up to about 1 mm. In one embodiment, the tip rail top surface is coplanar with the side rail top surfaces at the points of intersection between the side rails and the tip rail.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A clarinet mouthpiece and barrel system comprising:

a mouthpiece comprising a central mouthpiece bore passing through the mouthpiece from a tone chamber to a rear portion of the mouthpiece opposite the tone chamber, the mouthpiece bore comprising a cross-sectional geometry extending along an entire length of the mouthpiece bore that comprises a plurality of pairs of opposing parallel sides, each pair of opposing sides separated by a unique distance; and a barrel attached to the rear portion of the mouthpiece, the barrel comprising a central barrel bore in communication with the mouthpiece bore and passing completely through the barrel, the barrel bore comprising an identical cross-sectional geometry to the mouthpiece bore cross-sectional geometry along an entire length of the barrel bore.

2. The system of claim 1, wherein the mouthpiece bore comprises a rectangular cross-sectional geometry comprising two pairs of opposing parallel sides.

3. The system of claim 2, wherein the unique distances separating the two pairs of opposing sides comprise a ratio that generates transverse harmonics through the mouthpiece bore related to wavelengths of notes in an upper register of a clarinet.

4. The system of claim 3, wherein the ratio comprises 5/8.

5. The system of claim 3, wherein the unique distances comprise a first distance of about 10 mm and a second distance of about 16 mm.

6. The system of claim 1, wherein the unique distance associated with at least one of the pairs of opposing sides varies along the length of at least one of the mouthpiece bore and the barrel bore.

7. The system of claim 1, wherein the cross-sectional geometry of the mouthpiece bore and the barrel bore yields an associated acoustic impedance equivalent to a circular cross-section comprising an equivalent cross-sectional area.

8. The system of claim 1, wherein the mouthpiece comprises a length of about 100 mm, the mouthpiece bore comprises a length of about 35 mm, the barrel comprises a length of about 60 mm and the barrel bore comprises a length of from about 25 mm to about 30 mm.

9. The system of claim 8, wherein:

the mouthpiece comprises a tone chamber window in communication with the tone chamber; and the tone chamber window comprises a length of from about 50 mm to about 55 mm.

10. The system of claim 9, wherein the mouthpiece bore comprises a rectangular cross-sectional geometry comprising two pairs of opposing parallel sides, a longer pair and a shorter pair, the longer pair oriented parallel to opposite sides of the tone chamber extending down from the tone chamber window.

11. The system of claim 1, wherein the barrel bore comprises a rectangular cross-sectional geometry comprising two pairs of opposing parallel sides.

12. The system of claim 11, wherein the unique distances separating the two pairs of opposing sides comprise a ratio that generates transverse harmonics through the mouthpiece bore related to wavelengths of notes in an upper register of a clarinet.

13. The system of claim 12, wherein the ratio comprises 5/8.

14. The system of claim 12, wherein the unique distances comprise a first distance of about 10 mm and a second distance of about 16 mm.

15. The system of claim 1, wherein the barrel comprises a cylinder having an outer surface and a plurality of orientation marks spaced radially around the outer surface of the cylinder to indicate an orientation between the barrel bore cross-sectional geometry and at least one of the mouthpiece bore cross-sectional geometry and an instrument bore passing through the clarinet from the barrel to a bell end of the clarinet.

16. A clarinet mouthpiece and barrel system comprising:

a mouthpiece comprising a central mouthpiece bore passing through the mouthpiece from a tone chamber to a rear portion of the mouthpiece opposite the tone chamber, the mouthpiece bore comprising a rectangular cross-sectional geometry extending along an entire length of the mouthpiece bore that comprises a two pairs of opposing parallel sides, each pair of opposing sides separated by a unique distance such that a ratio of unique distances for the two pairs of opposing parallel sides is 5/8; and a barrel attached to the rear portion of the mouthpiece, the barrel comprising a central barrel bore in communication with the mouthpiece bore and passing completely through the barrel, the barrel bore comprising an identical rectangular cross-sectional geometry to the mouthpiece bore cross-sectional geometry along an entire length of the barrel bore.

17. The system of claim 16, wherein the mouthpiece comprises a length of about 100 mm, the mouthpiece bore comprises a length of about 35 mm, the barrel comprises a length of about 60 mm and the barrel bore comprises a length of from about 25 mm to about 30 mm.

18. The system of claim 17, wherein:

the mouthpiece comprises a tone chamber window in communication with the tone chamber; and the tone chamber window comprises a length of from about 50 mm to about 55 mm.

19. The system of claim 18, wherein a longer pair of parallel sides in the mouthpiece bore is oriented parallel to opposite sides of the tone chamber extending down from the tone chamber window.

20. The system of claim 16, wherein the barrel comprises a cylinder having an outer surface and a plurality of orientation marks spaced radially around the outer surface of the cylinder to indicate an orientation between the barrel bore cross-sectional geometry and at least one of the mouthpiece bore cross-sectional geometry and an instrument bore passing through the clarinet from the barrel to a bell end of the clarinet.

* * * * *